US009218796B2

(12) United States Patent
Ferrando

(10) Patent No.: US 9,218,796 B2
(45) Date of Patent: Dec. 22, 2015

(54) CLAMP FOR A SAXOPHONE OR CLARINET MOUTHPIECE

(75) Inventor: Francisco Espinosa Ferrando, Ciudad Real (ES)

(73) Assignee: Investigaciones Machegas, S.L., Ciudad Real (ES)

( * ) Notice: Subject to any disclaimer, the term of this patent is extended or adjusted under 35 U.S.C. 154(b) by 4 days.

(21) Appl. No.: 14/353,370

(22) PCT Filed: Jan. 10, 2012

(86) PCT No.: PCT/ES2012/000004

§ 371 (c)(1),
(2), (4) Date: Apr. 22, 2014

(87) PCT Pub. No.: WO2013/104806

PCT Pub. Date: Jul. 18, 2013

(65) Prior Publication Data

US 2014/0260891 A1 Sep. 18, 2014

(51) Int. Cl.

| | |
|---|---|
| ***G10D 9/02*** | (2006.01) |
| ***G10D 7/06*** | (2006.01) |
| ***G10D 7/08*** | (2006.01) |

(52) U.S. Cl.

CPC ..... *G10D 9/02* (2013.01); *G10D 7/066* (2013.01); *G10D 7/08* (2013.01)

(58) Field of Classification Search

CPC ..... G10D 9/02; G10D 9/00; G10D 9/043; G10D 7/00; G10D 9/023; G10D 7/066; G10D 9/026; G10G 5/00

USPC ..... 84/385 A, 383 A, 380 R

See application file for complete search history.

(56) References Cited

U.S. PATENT DOCUMENTS

| | | | | |
|---|---|---|---|---|
| 2,292,584 | A | 8/1942 | Tafarella | |
| 4,258,605 | A * | 3/1981 | Lorenzini | 84/386 |
| 4,991,483 | A * | 2/1991 | Petit | 84/383 R |

(Continued)

FOREIGN PATENT DOCUMENTS

| | | |
|---|---|---|
| ES | 2 351 024 | 1/2011 |
| GB | 2453960 | 4/2009 |

(Continued)

OTHER PUBLICATIONS

International Search Report issued Oct. 1, 2012 in International (PCT) Application No. PCT/ES2012/000004.

*Primary Examiner* — Kimberly Lockett

(74) *Attorney, Agent, or Firm* — Wenderoth, Lind & Ponack, L.L.P.

(57) ABSTRACT

A clamp includes a flexible, interior conical component in contact with a barrel and a rigid, exterior conical component in contact with the interior component. The interior component has a longitudinal cut over its entire length and has, at the part that contacts the barrel, two central recesses. The exterior component acts on the interior component, and has the same conicity as the interior component. The exterior component prevents unwanted opening of the interior component by exerting a pressure on the interior component. Both components have a central recess, which form, as a whole, a mouthpiece resonating box that provides greater sound volume and different timbres, depending on the size of the recess and on the material from which it is produced. The flexibility of the interior component prevents breaking of the barrel even though three interior rings thereof are placed in different planes.

4 Claims, 4 Drawing Sheets

(56) References Cited

U.S. PATENT DOCUMENTS

| | | | | |
|---|---|---|---|---|
| 5,249,499 | A * | 10/1993 | Goldstein et al. | 84/386 |
| 2012/0085218 | A1 | 4/2012 | Popa Tudor | |

FOREIGN PATENT DOCUMENTS

| | | |
|---|---|---|
| JP | 2003-337583 | 11/2003 |
| WO | 2011/020929 | 2/2011 |

* cited by examiner

CLAMP FOR A SAXOPHONE OR CLARINET MOUTHPIECE

OBJECT OF THE INVENTION

The present invention refers to a clamp for its use in connecting and holding the barrel to the mouthpiece in saxophones and clarinets.

The present invention discloses a clamp having two conical components: the inner component, which contacts the barrel and the mouthpiece, and the exterior rigid component, which embraces the interior flexible component, both components being manufactured from any type of material, or combination of materials, for use in those instruments which require the barrel and the mouthpiece to be connected. The interior component has, in its interior wall, closest to the mouthpiece and the barrel, two recesses in its central part, therefore having three interior rings: two at the ends and another one in the central part. The exterior component has a single recess in its interior central part, and it therefore has two conical rings in the ends in a single structure, one at the mouth of each cone.

Those recesses in the central part, in the case of the interior component, may have different dimensions depending on the desired tone.

BACKGROUND OF THE INVENTION

The mouthpiece and the barrel, which are fundamental components of the musical instruments disclosed herein, saxophone and clarinet, must be used together forming a single body, a part of the barrel being permanently contacting the mouthpiece and the other part being free, allowing a certain degree of flexibility and, therefore, the entrance of air in the mouthpiece and the body of the respective instruments. Nowadays, metallic clamps are being used in these types of instruments, the necessary clamping pressure being obtained by means of a screw connecting the two halves of the clamp together, there being more than two contact points with the barrel.

The drawback with this clamp is that, in addition to the loss of sound, since there is no acoustic chamber, since there are more than two contact points with the barrel, which may not be in the same plane, breaks can occur, and they occur, and also circular displacements.

On the other hand, clamps formed by a single, conical, rigid piece holding the barrel to the mouthpiece by means of pressure with a certain risk of breakage are recently being used. Those having a recess in their central interior part do not pose that risk, but they can only be used with a specific barrel, so that every time a different barrel is used, the clamp must be replaced by a new one whose dimensions correspond to those of the former both in thickness and in width.

The clamp disclosed herein solves the two drawbacks: the breakage risk, since the flexibility of the interior component contacting the barrel applies the precise clamping pressure due to its own physical characteristics, and the loss of sound, since both the interior and the exterior components, in view of their morphology, act as an acoustic chamber.

DESCRIPTION OF THE INVENTION

The two component clamp disclosed herein is made of any type of material, even each component may be made of a different material, depending on the desired tone or sound feature.

The interior conical component has a longitudinal opening all along its length that makes it flexible, allowing it to be adjusted to different barrels depending on their thickness and width. Its interior, where it contacts the barrel, has two central recesses forming three rings, one at each end and another one at the center, all three in the same plane, which result in two acoustic chambers, through which the sound cannot escape or be lost.

In addition, it has a ring in its exterior part, at the end located closest to the mouthpiece connector, for preventing the exterior component to exit or slide out.

The exterior component, also conical, is manufactured closed, having a central recess in the part which fits with the interior component, thus forming two rings, one at each end. The conical shape having the same axis inclination as the interior component, has as sole function preventing unwanted opening of the interior component and thus any unwanted movement of the same. Since there is also a central recess in its interior part, it also has an acoustic chamber.

Figure 1:
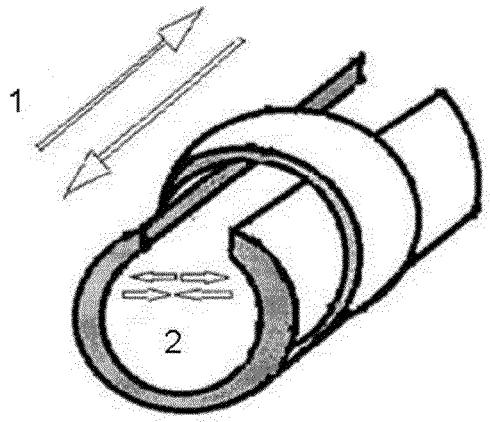
FIG. 1 shows a view of the clamp assembly where a longitudinal cross section of the interior component is disclosed, and where the adjustment closure movements of the assembly are described.

FIG. 1 shows a general view of the two components forming the adjustable flexible clamp for woodwind instruments. FIG. 1 also shows an adjustment ring movement 1 and a clamp closure movement 2 when the exterior ring is displaced.

Figure 2:
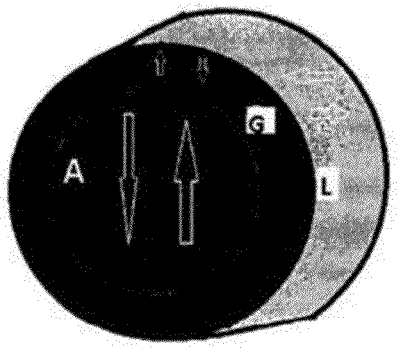
FIG. 2 shows a view of the exterior adjustment and closure ring with the different movements.

FIG. 2 shows the exterior adjustment and closure ring having a height A depending on the mouthpiece model, a thickness G depending on the desired sound effect, and a length L depending on the desired tone and adjustment of the barrel.

Figure 3:
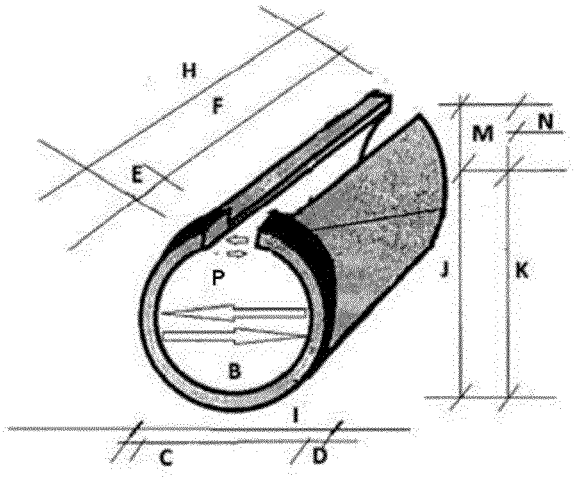
FIG. 3 shows the interior component, where the exterior ring can be seen at the end closest to the mouthpiece connector, thus preventing the exterior component to be pushed out and allowing for installing the clamp with a single movement.

FIG. 3 shows the adjustable and flexible interior ring, including a cut allowing for the adjustment in the direction of the arrows P. FIG. 3 also shows an inner body adjustment movement B, an interior dimension C according to the instrument, a total thickness D with a stopper, a width E of the stopper, and a length F of the rest of the clamp according to the instrument. Further, FIG. 3 shows a total length H according to the instrument, a total diameter I of the piece, and a total exterior diameter J according to the instrument. Additionally, FIG. 3 shows an exterior diameter K without the stopper, a thickness M with the stopper, and a stopper thickness N, where the thickness M with the stopper and the stopper thickness N correspond to the clamp thickness according to the desired effect.

Figure 4:
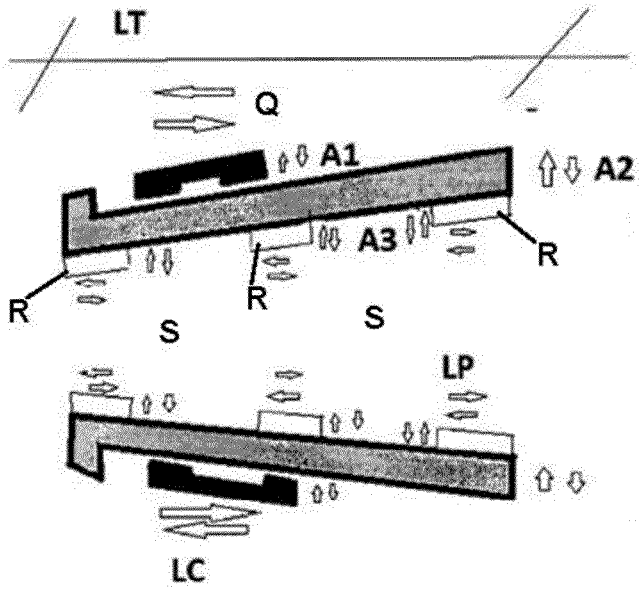
FIG. 4 shows the interior of the two components forming the assembly where the central recesses can be seen; this gives an idea of the different movements and the different ways of exerting pressure, either on the barrel or the interior component, or, although minimal, of the exterior component on the interior component.

FIG. 4 shows a section of the flexible and adjustable clamp, including the three rings R which form two acoustic chambers S. FIG. 4 also shows a total clamp length LT depending on the mouthpiece model and instrument, and an exterior ring adjustment movement Q. Further, FIG. 4 shows the thickness A1 of the exterior ring, the thickness A2 according to the desired sound effect, and the heights A3 of the rings R according to the desired sound effect. Additionally, FIG. 4 shows the lengths LP of the rings R according to the desired effect, and the length LC of the exterior ring according to the desired effect and the instrument of use.

The invention claimed is:

1. A clamp for a clarinet or a saxophone mouthpiece, comprising:

an interior conical flexible component, said interior component having a longitudinal open slit along its whole length and three inner rings forming two acoustic chambers; and an exterior rigid ring component capable of adjustably sliding along the external surface of the interior component for connecting a barrel of the clarinet or saxophone to the mouthpiece by means of pressure, said exterior component having two inner rings forming one acoustic chamber.

2. The clamp according to claim 1, wherein the three inner rings of the interior component are arranged such that two of the inner rings are located at opposite ends of the interior component, respectively, and such that the remaining inner ring is located at the center of the interior component.

3. The clamp according to claim 1, wherein the two inner rings of the exterior component are located at opposite ends of the exterior component, respectively.

4. The clamp according to claim 1, wherein the interior component comprises an outer lip at an end of the interior component which is located closest to a mouthpiece connector for preventing the exterior component from sliding out.

* * * * *